US009873140B2

(12) United States Patent
Sato et al.

(10) Patent No.: US 9,873,140 B2
(45) Date of Patent: Jan. 23, 2018

(54) FOREIGN MATERIAL REMOVING DEVICE OF TRACK TURNOUT PORTION

(75) Inventors: Masahumi Sato, Tokyo (JP); Shogo Kigami, Hyogo (JP); Yuki Kinugasa, Hyogo (JP)

(73) Assignees: NABTESCO CORPORATION, Tokyo (JP); EAST JAPAN RAILWAY COMPANY, Tokyo (JP)

( * ) Notice: Subject to any disclaimer, the term of this patent is extended or adjusted under 35 U.S.C. 154(b) by 141 days.

(21) Appl. No.: 14/345,191

(22) PCT Filed: Sep. 11, 2012

(86) PCT No.: PCT/JP2012/005750

§ 371 (c)(1),
(2), (4) Date: Jun. 25, 2014

(87) PCT Pub. No.: WO2013/038657

PCT Pub. Date: Mar. 21, 2013

(65) Prior Publication Data

US 2014/0345657 A1 Nov. 27, 2014

(30) Foreign Application Priority Data

Sep. 16, 2011 (JP) ..... 2011-203742
Aug. 6, 2012 (JP) ..... 2012-173757

(51) Int. Cl.
*B08B 5/02* (2006.01)
*E01B 7/20* (2006.01)
(Continued)

(52) U.S. Cl.
CPC ..... *B08B 5/02* (2013.01); *B61L 1/20* (2013.01); *B61L 5/02* (2013.01); *B61L 5/10* (2013.01); *E01B 7/20* (2013.01); *E01B 19/00* (2013.01)

(58) Field of Classification Search
CPC ..... B08B 5/02; B61L 1/20; B61L 5/02; B61L 5/10; E01B 7/20; D01B 19/00
(Continued)

(56) References Cited

U.S. PATENT DOCUMENTS 1,978,229 A * 10/1934 Sass ..... F16J 1/12 403/343
1,998,851 A * 4/1935 Shields ..... E01H 8/00 134/30

FOREIGN PATENT DOCUMENTS

GB 803530 10/1958
JP 3000050 U 4/1994
(Continued)

OTHER PUBLICATIONS

International Preliminary Report on Patentability (Chapter I of the Patent Cooperation Treaty) from the International Bureau of WIPO for International Application No. PCT/JP2012/005750 dated Mar. 18, 2014, 5 pages.
(Continued)

*Primary Examiner* — Michael Barr
*Assistant Examiner* — Tinsae Ayalew
(74) *Attorney, Agent, or Firm* — Fitch Even Tabin & Flannery LLP

(57) ABSTRACT

There is provided a foreign material removing device of a track turnout portion which can tightly attach and fix nozzles to a rail belly portion stably without machining a rail itself. A foreign material removing device of a track turnout portion which has point rails which can move to contact and move away from stock rails of the track turnout portion, and which removes a foreign material dropped between the stock rail and the point rail, includes a piping unit which includes a plurality of nozzle portions which spray compressed air to remove the foreign material, and the piping unit includes a close-contact arrangement structure in which the piping unit is arranged in close contact with a lateral surface of the stock rail opposed to the point rail.

14 Claims, 10 Drawing Sheets

(51) Int. Cl.

| | |
|---|---|
| ***B61L 1/20*** | (2006.01) |
| ***B61L 5/02*** | (2006.01) |
| ***B61L 5/10*** | (2006.01) |
| ***E01B 19/00*** | (2006.01) |

(58) Field of Classification Search
USPC ..... 134/198
See application file for complete search history.

(56) References Cited

FOREIGN PATENT DOCUMENTS

| | | |
|---|---|---|
| JP | H07-54317 A | 2/1995 |
| JP | 2000-144602 A | 5/2000 |

OTHER PUBLICATIONS

International Search Report from the International Bureau of WIPO for International Application No. PCT/JP2012/005750 dated Dec. 18, 2012 and English translation of the same (2 pages).
The extended European search report dated Aug. 10, 2015 for European Patent Application No. 12832037.1. (6 pages).

* cited by examiner

FOREIGN MATERIAL REMOVING DEVICE OF TRACK TURNOUT PORTION

CROSS-REFERENCE TO RELATED APPLICATIONS

This application is a U.S. national phase application filed under 35 U.S.C. § 371 of International Application PCT/JP2012/005750, filed on Sep. 11, 2012, designating the United States, which claims priority from Japanese Application Number 2011-203742, filed Sep. 16, 2011, and Japanese Application Number 2012-173757, filed Aug. 6, 2012, which are hereby incorporated herein by reference in their entirety.

TECHNICAL FIELD

The present invention relates to a foreign material removing device of a track turnout portion which removes foreign materials near the track turnout portion of a railroad by air injection. More particularly, the present invention relates to a foreign material removing device of a track turnout portion which removes foreign materials near point rails by air injection.

BACKGROUND ART

Conventionally, dropped snow or ice which drops due to vibration caused when a vehicle passes a track turnout portion, rocks thrown when dropped snow or ice drops on ballasts and the ballasts jump, or the like, are sandwiched between a stock rail of the track turnout portion and a point rail, and there is a problem that the point rails are not shifted. Hence, various foreign material removing devices of track turnout portions have been developed or researched.

For example, Japanese laid-open patent publication No. 2000-144602 A discloses a foreign material removing device of a track turnout portion which can supply compressed air supplied from a compressed air source device through a compressed air supply path, to a piping unit through a piping joint portion disposed below a stock rail, and can be easily installed on the stock rail without specially machining the stock rail.

The foreign material removing device of the track turnout portion disclosed in Japanese laid-open patent publication No. 2000-144602 A is a device which has point rails which can move to contact and move away from the stock rails, and removes a foreign material dropped between the stock rail of the track turnout portion to which a rail stopper which regulates an interval between the stock rail and the point rail is fixed to a lateral surface of the stock rail opposed to the point rail, and the point rail, has: the piping unit which is provided to the lateral surface of the stock rail opposed to the point rail; the compressed air source device which is installed near the track turnout portion and is connected to the piping unit through the compressed air supply path; a plurality of nozzle portions which are provided by being arranged in a longitudinal direction of the piping unit, and spray the compressed air from the compressed air source device to a front end side of the point rail; and the piping joint portion which is disposed closer to a back end side of the point rail than the rail stopper and below the stock rail, and connects the piping unit and the compressed air supply path, and has features that the rail stopper is screwed to the stock rail by an attaching bolt which penetrates the stock rail in the horizontal direction, and the piping unit is screwed to the stock rail together with the rail stopper by the attaching bolt.

SUMMARY OF THE INVENTION

Although an effect of the foreign material removing device of the track turnout portion disclosed in Japanese laid-open patent publication No. 2000-144602 A can be acknowledged, when the bolt provided in the horizontal direction is tightly fastened, a fixing bracket formed in an L shape in Japanese laid-open patent publication No. 2000-144602 A rotates, and there is a problem that a gap is produced between a rail belly portion and the nozzles.

It is therefore an object of the present invention to provide a foreign material removing device of a track turnout portion which can tightly attach and fix nozzles stably to a rail belly portion without machining a rail itself.

(1)

A foreign material removing device of a track turnout portion according to one aspect is a foreign material removing device of a track turnout portion which includes a point rail which can move to contact and move away from a stock rail of the track turnout portion, and which removes a foreign material dropped between the stock rail and the point rail, and includes a piping unit which includes a plurality of nozzle portions which spray compressed air to remove the foreign material, and the piping unit includes a close-contact arrangement structure provided in a state where the piping unit presses against a concave portion of a lateral surface of the stock rail opposed to the point rail.

In this case, according to the close-contact arrangement structure, the piping unit is arranged in close contact with the concave portion (rail belly portion) of the lateral surface of the stock rail opposed to the point rail without performing special machining such as machining to open new holes in the rail itself, so that it is possible to tightly attach and fix the nozzles of the piping unit stably to the rail belly portion and prevent an interference between the nozzles and the point rail. That is, the close-contact arrangement structure adopts a structure provided in a state where the piping unit presses against the rail belly portion, and, therefore even when a shape of the rail in the longitudinal direction, that is, the shape of the rail belly portion in particular has some concavities and convexities or when compressed air is sprayed, keeps a state where the piping unit is in close contact with the concave portion of the lateral surface of the stock rail. As a result, it is possible to prevent the piping unit from interfering with the point rail and, consequently, prevent the piping unit from being damaged and reliably remove foreign materials between the stock rail and the point rail.

(2)

A close-contact arrangement structure of the foreign material removing device of a track turnout portion according to the second aspect of the invention is preferably a structure, in the foreign material removing device of the track turnout portion according to the one aspect, whose angle from a horizontal plane of a surface of the piping unit opposed to the concave portion of the lateral surface is an acute angle toward the concave portion of the lateral surface.

In this case, the angle of the piping unit from the horizontal plane toward the concave portion of the lateral surface is an acute angle, so that the piping unit elastically deforms with respect to the concave portion of the lateral surface of the stock rail, that is, the belly portion of the stock rail, and the piping unit is provided in a state where the piping unit reliably presses against the concave portion of the lateral surface while the configuration is simple. As a result, the entire length of the piping unit is reliably attached tightly to the concave portion of the lateral surface and, as a result, the piping unit is stably fixed.

(3)

A foreign material removing device of a track turnout portion according to a third aspect of the invention is the foreign material removing device of the track turnout portion according to the one aspect or the second aspect of the invention, where the piping unit preferably extends from below the stock rail to a lateral surface side which does not oppose the point rail, and is fastened by way of screwing in a vertical direction by a member which includes a tapered surface on a leg portion of the stock rail.

In this case, the piping unit is fastened by way of screwing in the vertical direction by the member which includes the tapered surface, so that component forces in the horizontal direction and the vertical direction are produced in the leg portion of the stock rail, the bottom surface of the stock rail and the surface of the piping unit opposed to this bottom surface are tightly attached by the force in the vertical direction, and the piping unit is tightly attached to the stock rail while sandwiching the stock rail by the component force in the horizontal direction and, consequently, it is possible to reliably fix the piping unit in a state where the piping unit is tightly attached to the stock rail.

(4)

A foreign material removing device of a track turnout portion according to a fourth aspect of the invention is the foreign material removing device of the track turnout portion according to the one aspect or the second aspect or the third aspect of the invention, where the close-contact arrangement structure is provided separately with a fixing portion which presses the piping unit against the concave portion of the lateral surface of the stock rail opposed to the point rail to fix, and a compressed air supply portion which supplies the compressed air to the piping unit.

In this case, in the close-contact arrangement structure, the fixing portion presses the piping unit against the concave portion of the lateral surface of the stock rail to fix. Further, the compressed air supply portion which is provided separately from the fixing portion supplies compressed air to the piping unit. Consequently, it is possible to fix the piping unit faster to the stock rail than a case where the piping unit is fixed by a hollow member which supplies compressed air to the piping unit.

(5)

A foreign material removing device of a track turnout portion according to a fifth aspect of the invention is the foreign material removing device of the track turnout portion according to the one aspect or the second aspect to the fourth aspect of the invention, where the compressed air supply portion includes an extendable mechanism.

In this case, the compressed air supply portion includes the extendable mechanism, so that, even when the stock rail is displaced due to vibration caused when a vehicle travels, the extendable mechanism can absorb this displacement and supply compressed air. Consequently, it is possible to prevent failure, damages or cracks or the like of the foreign material removing device caused by the displacement.

DETAILED DESCRIPTION OF THE PREFERRED EMBODIMENTS

Hereinafter, embodiments of the present invention will be described using the figures. A state where nozzles for a foreign material removing device of a track turnout portion is applied to a track of a bullet train will be described in the present embodiment. In addition, the nozzles for the foreign material removing device of the track turnout portion can be used not only for tracks for bullet trains but also for other tracks such as of conventional railway lines.

(Configuration of Track Turnout Portion)

Figure 1:
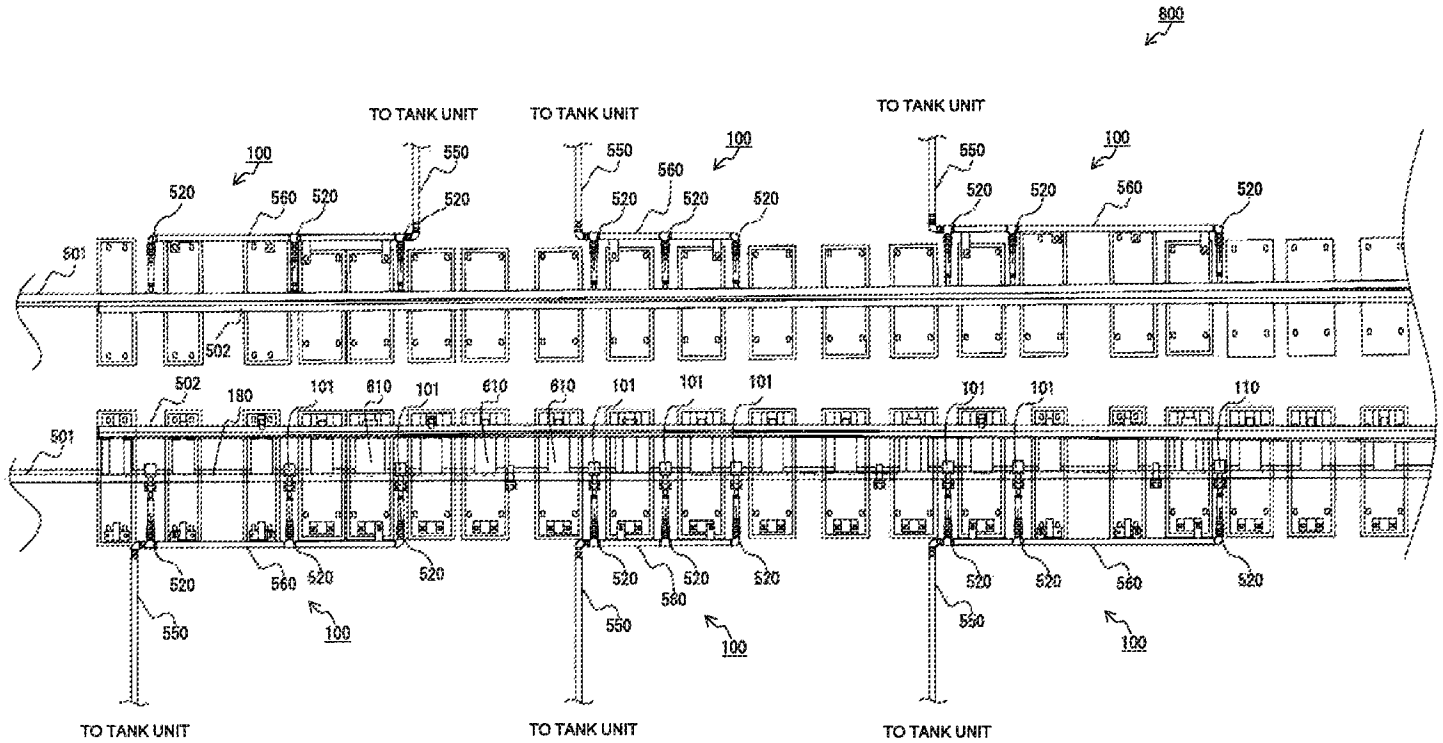
FIG. 1 is a schematic plan view illustrating an example of a configuration of a track turnout portion according to a first embodiment.

First, FIG. 1 is a schematic plan view illustrating an example of a configuration of a track turnout portion according to a first embodiment.

As illustrated in FIG. 1, a pair of stock rails 501 and a pair of point rails 502 are mainly installed on a track turnout portion 800. As illustrated in FIG. 1, the pair of point rails 502 are provided between the pair of stock rails 501.

In addition, the stock rails 501 of the track turnout portion 800 illustrated in FIG. 1 are disposed on sleepers. Further, the point rails 502 are arranged on floorboards 610 which include bearings arranged on the sleepers, and are movably configured. By this means, each point rail 502 is provided to be capable of contacting and moving away from each stock rail 501 by a point switching device (not illustrated).

Generally, when points (not illustrated) actuate based on a command from a control device (not illustrated), the point rails 502 move in a direction to contact or move away from the stock rails 501, and an operation (point switching operation) of switching traveling rails of the track turnout portion 800 is performed. As a result, a railway vehicle which travels on the track turnout portion 800 can travel in one of directions of main rails (not illustrated) and the stock rails 501.

(Schematic Configuration of Foreign Material Removing Device)

A foreign material removing device 100 mainly has nozzle devices 101, main pipes 550 and 560, branch pipes 520 and a tank unit 200.

As illustrated in FIG. 1, the main pipe 550 is connected to an air tank 220 of the tank unit 200, and the main pipe 550 connects to the main pipe 560. Further, the main pipes 560 are disposed in parallel to the stock rails 501.

A plurality of branch pipes 520 are provided to branch from the main pipe 560, and a nozzle device 101 is provided at a front end of the branch pipe 520. The branch pipe 520 is provided between one floorboard 610 and the neighboring floorboard 610. That is, there is a space between one floorboard 610 and the neighboring floorboard 610 and below the stock rails 501.

In addition, as described below, the nozzle device 101 has a pipe 180 and nozzle portions 110, and is provided to a belly portion of the stock rail 501 (see FIGS. 3 and 4).

(Schematic Configuration of Tank Unit)

Figure 2:
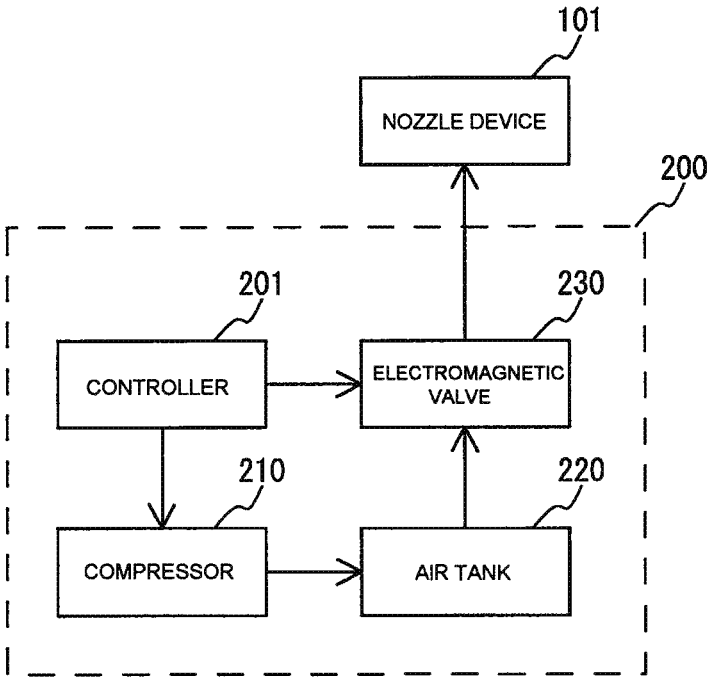
FIG. 2 is a schematic view illustrating a schematic configuration of a tank unit.

FIG. 2 is a schematic view illustrating a schematic configuration of the tank unit 200. As illustrated in FIG. 2, the tank unit 200 mainly has a controller 201, a compressor 210, the air tank 220 and an electromagnetic valve 230.

The controller 201 controls the compressor 210 to drive and controls the electromagnetic valve 230 to open and close. The compressor 210 compresses an outside air according to the command of the controller 201, and supplies the outside air to the air tank 220. The air tank 220 stores the compressed air. The electromagnetic valve 230 performs an opening operation according to a switch command from the controller 201, and supplies the compressed air stored in the air tank 220, to the nozzle device 101 through the main pipes 550 and 560 and the branch pipes 520 (see FIG. 1).

More specifically, for example, the controller 201 outputs a switch command to the electromagnetic valve 230 based on detection results of various sensors such as a sensor (not illustrated) for detecting that snow or foreign materials drop or a snow sensor (not illustrated), operation command signals of various equipment such as an operation signal of a point (a point switch signal) or a signal generated by a timer or the like on a regular basis. As a result, the nozzle device 101 sprays the compressed air to perform an operation of removing foreign materials.

In addition, although an example where one air tank 220 is used has been described with reference to FIG. 2, the air tank is not limited to this, and a plurality of air tanks may be used and, when, for example, the tank unit 200 cannot be arranged near a track such as an elevated track, the electromagnetic valve 230, the controller 201 and only a small air tank may be provided near the track and the compressor 210 or the big air tank 220 may be arranged below the elevated track.

Figure 3:
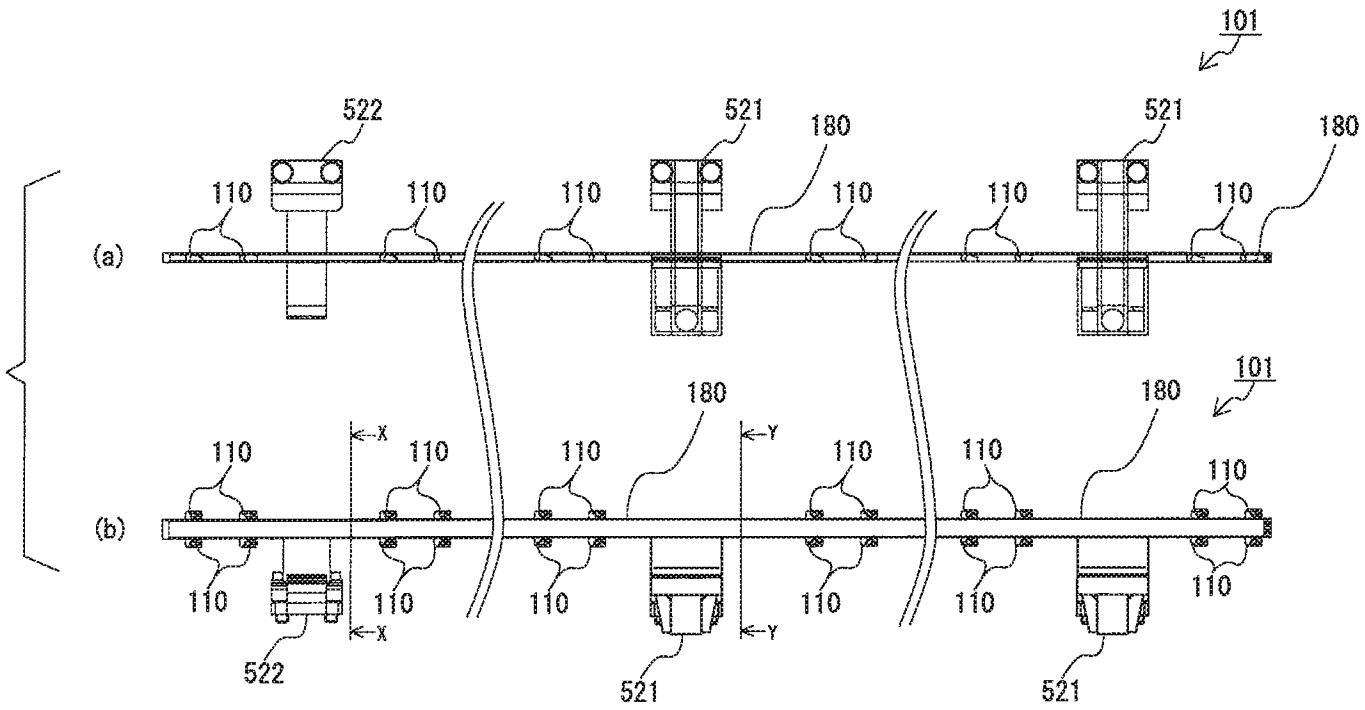
FIG. 3 is a schematic view for explaining details of a nozzle device.
Figure 4:
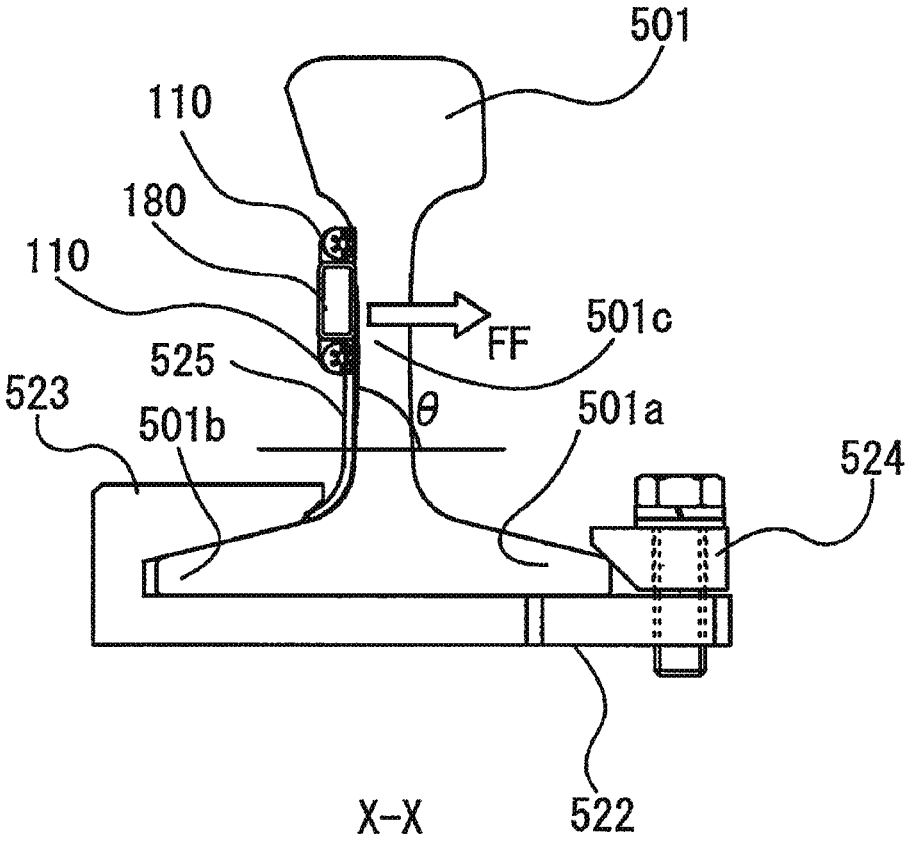
FIG. 4 is an X-X line cross-sectional view of FIG. 3.
Figure 5:
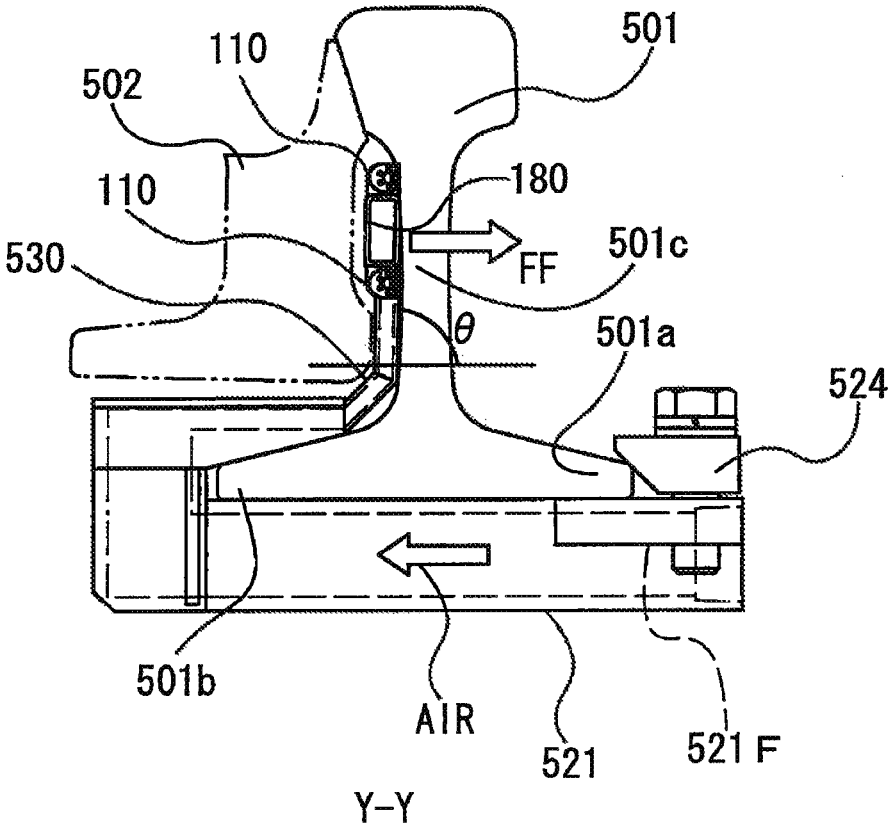
FIG. 5 is a Y-Y line cross-sectional view of FIG. 3.
Figure 6:
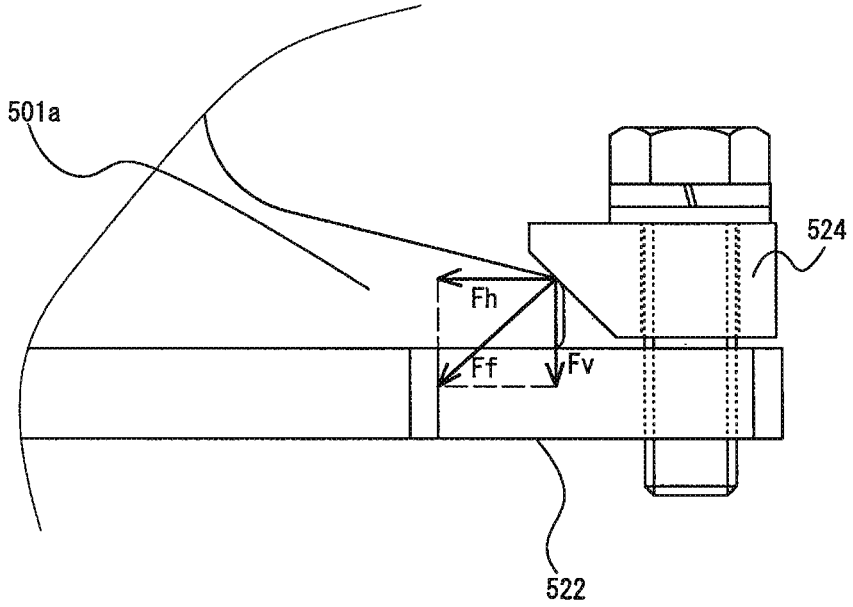
FIG. 6 is a view for explaining an effect of a fixing member in FIG. 4.

FIG. 3 is a schematic view for explaining the details of the nozzle device 101, FIG. 4 is an X-X line cross-sectional view of FIG. 3, FIG. 5 is a Y-Y line cross-sectional view of FIG. 3 and FIG. 6 is a view for explaining an effect of a fixing member in FIG. 4.

FIG. 3(*a*) illustrates a top view of the nozzle device 101 and FIG. 3(*b*) illustrates a side view of the nozzle device 101.

As illustrated in FIG. 3, the nozzle device 101 mainly has joint portions 521 which are connected with the branch pipes 520, a fixing member 522 which is not connected with the branch pipe 520, the pipe 180 which is a nearly square pipe and a plurality of the nozzle portions 110.

The joint portions 521 are provided at predetermined intervals of the pipe 180 and, when there is an interval between the joint portion 521 and the neighboring joint portion 521, the fixing member 522 is provided.

Further, the nozzle portions 110 are arranged at predetermined intervals on the upper and lower surfaces of the pipe 180. Furthermore, although a plurality of the nozzle portions 110 are provided, all the nozzle portions 110 may be formed in the same shape. Still further, the nozzle portions 110 provided on the upper and lower surfaces of the pipe 180 may have attack angles which are alternately different toward the point rails 502 on the upper surface or the lower surface of the pipe 180. For example, one attack angle is in a range of 5 degrees or more to 10 degrees or less, and the other attack angle is in a range of more than 10 degrees to 20 degrees or less.

(Close-Contact Arrangement Structure)

Next, as illustrated in FIG. 4, the fixing member 522 is provided along a lower surface of leg portions 501*a* and 501*b* (lowermost portions) of the stock rail 501, and a fixing member 524 having a tapered surface is provided on the upper surface of the leg portion 501*a* and is fastened in a vertical direction by a bolt. Further, a fixing portion 523 of the fixing member 522 is provided on the upper surface of the leg portion 501*b*. The fixing portion 523 supports the pipe 180 by means of the fixing member 525. In addition, the fixing member 525 is bent such that the pipe 180 at the belly portion 501*c* of the stock rail 501 is pressed (a force in a direction of an arrow FF) in a direction from the left side to the right side of the stock rail 501 in FIG. 4.

More specifically, as illustrated in FIG. 4, an angle formed between the pipe 180 and a horizontal portion (horizontal plane) of the fixing member 522, that is, an angle θ, is preferably an acute angle. For example, the angle θ is preferably 80 degrees to less than 90 degrees and is more preferably 85 degrees to 89 degrees. By this means, elastic deformation of the fixing member 525 produces the force of the arrow FF at the belly portion 501*c* of the stock rail 501 at all times. In addition, the force of the arrow FF is such a force that a problem that the position of the pipe 180 is shifted when compressed air is sprayed or the like does not occur.

As a result, it is possible to prevent the pipes 180 and the nozzle portions 110 from moving toward the point rails 502, and prevent the pipes 180 and a plurality of the nozzle portions 110 from interfering with the point rails 502 even when the point rails 502 come the closest to the stock rails 501.

As illustrated in FIG. 6, the fixing member 524 which has a tapered surface is provided on the upper surface of the leg portion 501*a* and the fixing member 524 is fastened in the vertical direction by the bolt, so that a force Fh in the horizontal direction and a force Fv in the vertical direction (which are F as a resultant force) apply to the leg portion 501*a*. That is, the force Fv in the vertical direction tightly attaches the bottom surface of the stock rails 501 and the surface of the fixing member 522 opposed to the bottom surface. Further, the force Fh in the horizontal direction causes the fixing portion 523 and the fixing member 524 to sandwich the stock rail 501, so that the pipe 180 supported by the fixing member 525 fixed by being sandwiched by the fixing member 523 and the leg portion 501*b* tightly attaches to the stock rail 501. As a result, it is possible to reliably hold the pipes 180 and the like without performing special machining such as machining to open holes in the stock rails 501. Further, the fixing member is fastened by a bolt from above in the vertical direction instead of being fastened by a bolt in the horizontal direction, so that operability is good and the fixing member is easily fixed.

Next, as illustrated in FIG. 5, in a Y-Y cross section, a hollow joint portion 521 in which compressed air circulates is provided along the lower surface of the leg portions 501*a* and 501*b* (lowermost portions) of the stock rail 501. That is, the joint portion 521 is provided from a side of the stock rail 501 which does not oppose the point rail 502 to a side of the stock rail 501 which opposes to the point rail 502 and along the lower surface of the stock rail 501.

Further, the joint portion 521 extends to the belly portion 501*c* (center concave portion) of the stock rail 501, and is provided with the pipe 180 at a front end. Meanwhile, a bent portion 530 which is provided halfway to the joint portion 521 is disposed at a position along the stock rail 501 such that the bent portion 530 does not interfere with the point rail 502 even when the point rail 502 comes the closest to the stock rail 501, and also has the thickness which does not interfere with the point rail 502.

Further, the bent portion 530 is bent such that the pipe 180 at the belly portion 501*c* of the stock rail 501 is applied a force (a force in a direction of an arrow FF) to be pressed from the point rail 502 side to a direction opposite to the point rail 502.

More specifically, as illustrated in FIG. 5, an angle formed between the pipe 180 and a horizontal portion (horizontal plane) of the joint portion 521, that is, the angle θ, is preferably an acute angle. For example, the angle θ is preferably 85 degrees to less than 90 degrees and is more preferably 85 degrees to 89 degrees. By this means, elastic deformation of the bent portion 530 can cause the pipe 180 to produce the force of the arrow FF at the belly portion 501*c* of the stock rail 501 at all times. In addition, the force of the arrow FF is such a force that a problem that the position of the pipe 180 is shifted when compressed air is sprayed and the like does not occur.

As a result, it is possible to prevent the pipes 180 and the nozzle portions 110 from moving toward the point rails 502, and prevent the pipes 180 and a plurality of the nozzle portions 110 from interfering with the point rails 502 even when the point rails 502 come the closest to the stock rails 501.

Further, in case of FIG. 5, the fixing member 524 described with reference to FIGS. 4 and 6 is provided, and a flange portion 521F of the joint portion 521 is further fixed to the joint portion 521 in the front-back direction (the vertical direction in the figure) of the stock rail 501. Furthermore, the fixing member 524 can be fastened to the flange portion 521F of the joint portion 521 from above in the vertical direction, so that it is possible to reliably hold the pipes 180 and the like without performing special machining such as machining to open holes in the stock rails 501 similarly as described above. Still further, the fixing member is fastened by a bolt from above in the vertical direction instead of being fastened by a bolt in the horizontal direction, so that operability is good and the fixing member is easily fixed.

Moreover, the flange portion 521F is provided to include a position to contact the lower surface of the leg portion 501*a* (lowermost portion) of the stock rail 501, and the force Fv in the vertical direction does not directly apply to the joint portion 521 which is a hollow member, so that the joint portion 521 is not deflected and can be more tightly attached.

(Nozzle Portion)

As illustrated in FIG. 3, the nozzle portion 110 is formed with a cylindrical body and a holding portion which holds the cylindrical body. The nozzle portion 110 is held by the holding portion such that the cylindrical body is directed in the substantially same direction as an extension direction of the pipe 180, and is formed in an L shape. Further, the cylindrical body has an inclined portion, and the inclined portion is arranged by being directed toward the point rail 502. As a result, it is possible to widen a spray angle from the nozzle portion 110 with respect to the horizontal plane.

Further, a plurality of rectangular slits are disposed in a radial pattern from a center of a virtual circle in a top panel of the cylindrical body. As a result, the slits are formed as rectangular columnar holes without providing orifice portions like general nozzles, so that it is possible to reduce noise.

In addition, although the nozzle portion 110 has a shape which prevents noise in the present embodiment, the nozzle portion 110 is not limited to this and other arbitrary nozzle portions may be used.

As described above, in the foreign material removing device 100 of the track turnout portion 800 according to the present invention, the pipes 180 and the nozzle portions 110 are arranged in close contact with the lateral surface sides of the stock rails 501 opposed to the point rails 502, by the bent portions 530 of the joint portions 521.

That is, in this structure, the bent portion 530 or the fixing member 525 elastically deforms with respect to the belly portion 501*c* of the lateral surface of the stock rail 501 such that the bent portion 530 of the joint portion 521 or the fixing member 525 causes the pipe 180 and the nozzle portion 110 to press against the belly portion 501*c* of the lateral surface of the stock rail 501 (pressed by the force in the direction of the arrow FF). Consequently, it is possible to reliably arrange the pipes 180 at positions at which the pipes 180 do not interfere with the point rails 502 during construction without performing special machining such as machining to open holes in rails themselves, and prevent the pipes 180 and the nozzle portions 110 from being displaced toward the point rails 502 even when compressed air is sprayed. The nozzles are tightly attached and fixed stably to the stock rails 501 in this way, so that it is possible to reliably prevent the pipes 180 and the nozzle portions 110 from interfering with the point rails 502. As a result, it is possible to reliably prevent the pipes 180 and the nozzle portions 110 from being damaged and reliably remove foreign materials between the stock rails 501 and the point rails 502.

Further, the fixing members 524 having the tapered surfaces are fastened by bolts in the vertical direction, so that it is possible to disperse the force Fh in the horizontal direction and the force Fv in the vertical direction in the leg portions 501*a* of the stock rails 501 and reliably tightly attach and fix the nozzle devices 101 or the pipes 180 to the stock rails 501.

Second Embodiment

Next, a second embodiment of the present invention will be described. Differences of a foreign material removing device 100*a* of a track turnout portion 800 according to the second embodiment from the foreign material removing device 100 of the track turnout portion 800 according to the first embodiment will mainly be described.

Figure 7:
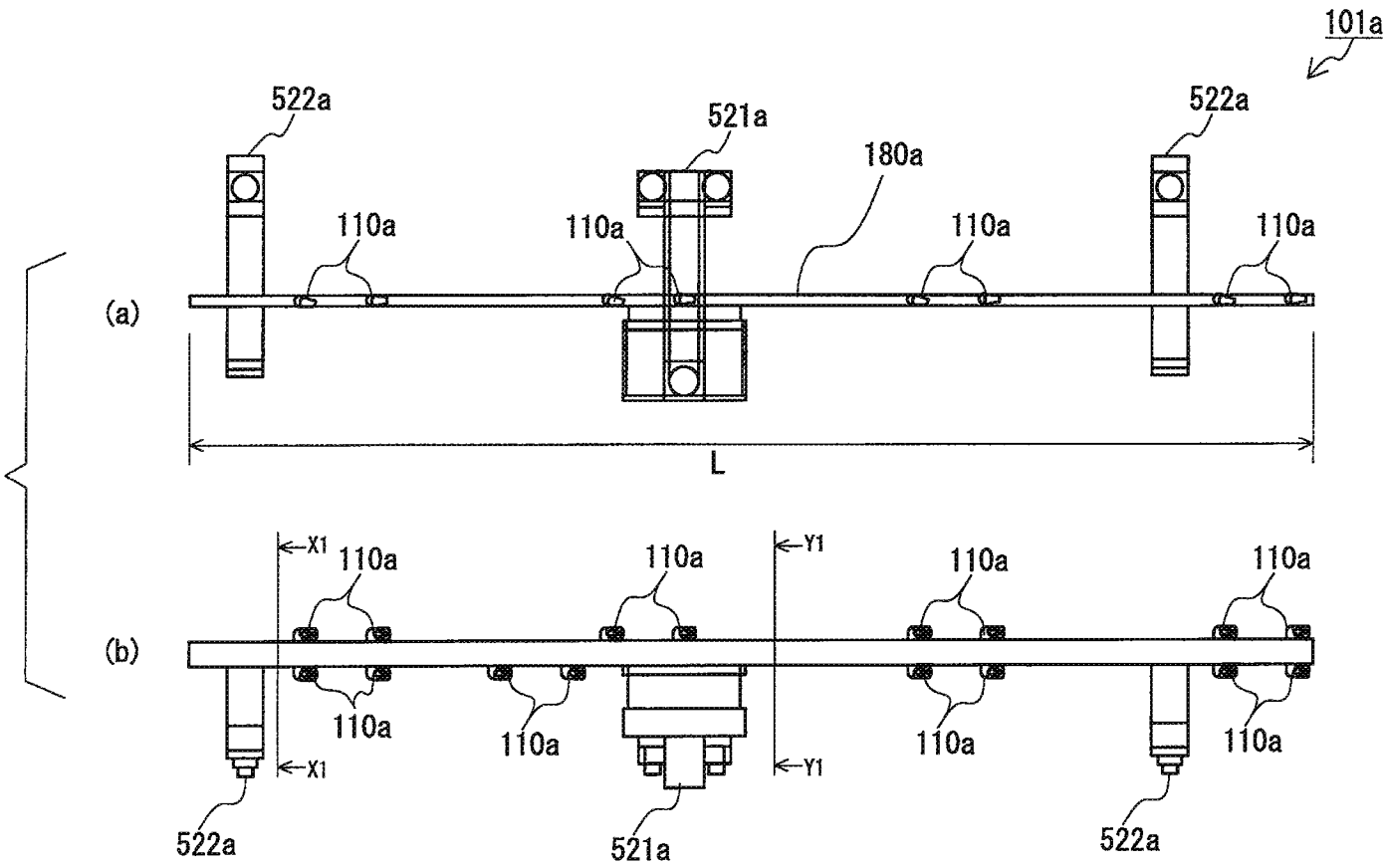
FIG. 7 is a schematic view for explaining details of a nozzle device according to the second embodiment.
Figure 8:
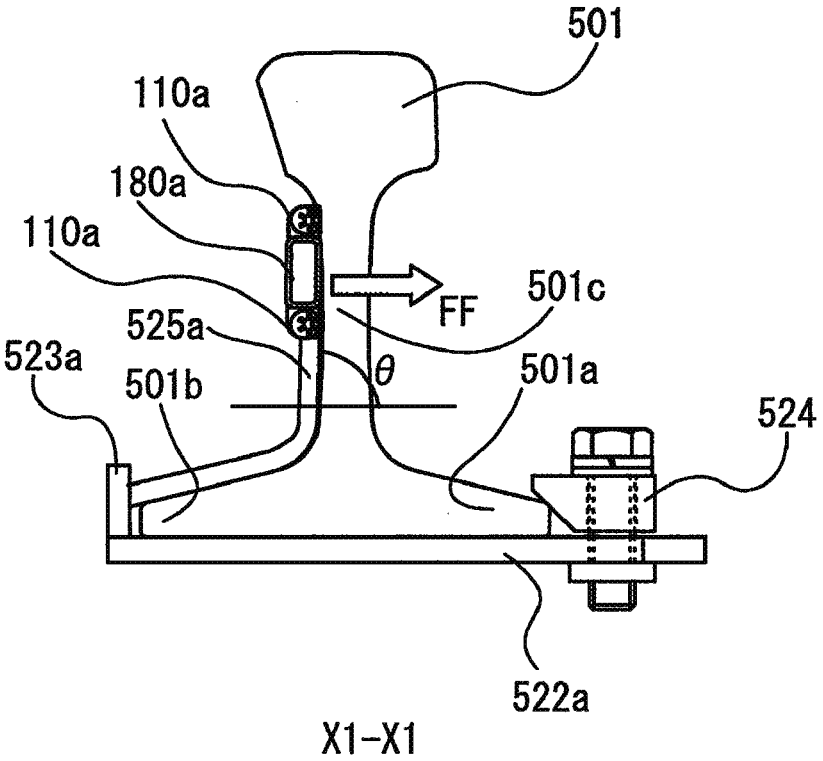
FIG. 8 is an X1-X1 line cross-sectional view of FIG. 7.
Figure 9:
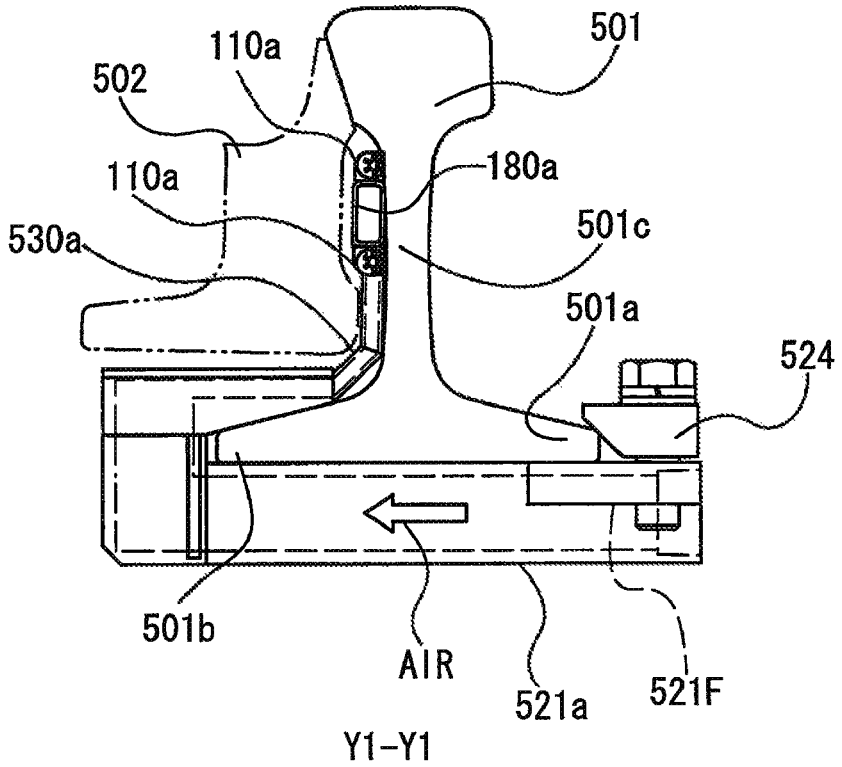
FIG. 9 is a Y1-Y1 line cross-sectional view of FIG. 7.

FIG. 7 is a schematic view for explaining details of a nozzle device 101*a* according to the second embodiment, FIG. 8 is an X1-X1 line cross-sectional view of FIG. 7, and FIG. 9 is a Y1-Y1 line cross-sectional view of FIG. 7.

FIG. 7(*a*) illustrates a top view of the nozzle device 101*a*, and FIG. 7(*b*) illustrates a side view of the nozzle device 101*a*.

As illustrated in FIG. 7, the nozzle device 101*a* mainly has a joint portion 521*a* which is connected with a branch pipe 520, fixing members 522*a* which are not connected with the branch pipe 520, a pipe 180*a* which is a nearly square pipe and a plurality of nozzle portions 110*a*.

As illustrated in FIG. 7, unlike the nozzle device 101 disclosed in the first embodiment, in the nozzle device 101*a*, the joint portion 521*a* is provided at one position, and the fixing members 522*a* are provided on both sides of the joint portion 521*a*.

Further, as illustrated in FIG. 7, a length L of the pipe 180*a* is in the range of about 0.5 m to 1.5 m. Furthermore, the length L of the pipe 180*a* is more preferably 1 m.

Still further, similar to the nozzle device 101, the nozzle portions 110*a* are arranged at predetermined intervals in the upper and lower surfaces of the pipe 180*a*.

(Close-Contact Arrangement Structure)

Next, as illustrated in FIG. 8, a solid fixing member 522*a* is provided along a lower surface of leg portions 501*a* and 501*b* (lowermost portions) of a stock rail 501, and a fixing member 524 having a tapered surface is provided on the upper surface of the leg portion 501*a* and is fastened in a vertical direction by a bolt. Further, a solid fixing member 523*a* welded to the fixing member 522*a* is provided in the vertical direction in the upper surface of the leg portion 501*b*. Furthermore, one end of a solid fixing member 525*a* which has a bent portion along the stock rail 501 is welded to the fixing member 523*a*. The pipe 180*a* is supported at the other end of the fixing member 525*a*.

In addition, in the second embodiment, the fixing member 525*a* has a bent portion formed such that the pipe 180*a* at a belly portion 501*c* of the stock rail 501 is pressed (a force in a direction of an arrow FF) in a direction from the left side to the right side of the stock rail 501 in FIG. 8.

More specifically, as illustrated in FIG. 8, an angle formed between the pipe 180*a* and a horizontal portion (horizontal plane) of the fixing member 522*a*, that is, an angle θ, is preferably an acute angle. For example, the angle θ is preferably 85 degrees to less than 90 degrees and is more preferably 85 degrees to 89 degrees. By this means, elastic deformation of the fixing member 525*a* causes the pipe 180*a* to produce the force of the arrow FF at the belly portion 501*c* of the stock rail 501 at all times. In addition, the force of the arrow FF is such a force that a problem that the position of the pipe 180*a* is shifted when compressed air is sprayed or the like does not occur.

As a result, it is possible to prevent the pipes 180*a* and the nozzle portions 110*a* from moving toward the point rails 502, and prevent the pipes 180*a* and a plurality of nozzle portions 110*a* from interfering with the point rails 502 even when the point rails 502 come the closest to the stock rails 501.

Next, as illustrated in FIG. 9, in a Y1-Y1 cross section, a hollow joint portion 521*a* in which compressed air circulates is provided along the lower surface of the leg portions 501*a* and 501*b* (lowermost portions) of the stock rail 501. That is, the joint portion 521*a* is provided from a side of the stock rail 501 which does not oppose the point rail 502 to a side of the stock rail 501 which opposes to the point rail 502 and along the lower surface of the stock rail 501.

Further, the joint portion 521*a* extends to the belly portion 501*c* (center concave portion) of the stock rail 501, and is provided with the pipe 180*a* at a front end. Meanwhile, a bent portion 530*a* which is provided halfway to the joint portion 521*a* is provided at a position along the stock rail 501 such that the bent portion 530*a* does not interfere with the point rail 502 even when the point rail 502 comes the closest to the stock rail 501, and also has the thickness which does not interfere with the point rail 502.

Further, unlike the bent portion 530 according to the first embodiment, in the second embodiment, the bent portion 530*a* is formed such that the pipe 180*a* at the belly portion 501*c* of the stock rail 501 does not apply the force FF to the point rail 502.

Another Example

Figure 10:
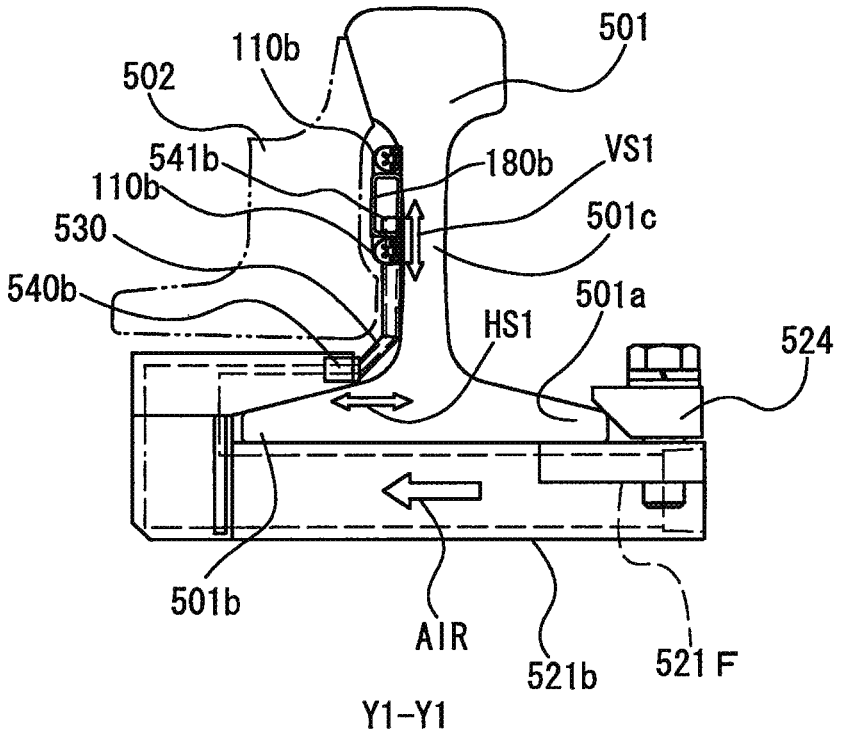
FIG. 10 is a cross-sectional view illustrating another example of FIG. 9.

FIG. 10 is a schematic cross-sectional view illustrating another example of a joint portion 521*a* in FIG. 9. In another example, "b" will be mainly added to the ends of reference numerals for the description and the reference numerals of the same numerical values will mean the substantially same functions and structures.

As illustrated in FIG. 10, unlike a joint portion 521*a* in FIG. 9, a joint portion 521*b* has slide mechanisms 540*b* and 541*b*.

The slide mechanism 540*b* is provided at one end side of a bent portion 530, and is slidably provided in a direction of an arrow HS1 which is a horizontal direction.

Similarly, the slide mechanism 541*b* is provided at the other end side of the bent portion 530, and is slidably provided in a direction of an arrow VS1 which is a vertical direction.

As a result, even when the stock rails 501 vibrate, the slide mechanisms 540*b* and 541*b* can absorb vibration, so that it is possible to prevent damages, cracks, failure or the like of the nozzle devices 101*b*.

As described above, the nozzle devices 101*a* and 101*b* of the foreign material removing devices 100*a* and 100*b* according to the second embodiment have a length of about 1 m, so that it is possible to improve attachment operability. Further, attaching the nozzle devices by avoiding other devices which are originally provided to the stock rails 501 also becomes easy.

Furthermore, the fixing members 522*a*, 523*a* and 525*a* press the piping units 180*a* against concave portions 501*c* of lateral surfaces of the stock rails 501 to fix. Still further, the joint portion 521*a* which is provided separately from the fixing members 522*a*, 523*a* and 525*a* supplies compressed air to the piping unit 180*a*. Consequently, the piping unit 180*a* is not fixed by the joint portion 521*a* which is a hollow member which supplies compressed air to the piping unit 180*a*, so that it is possible to fix the piping unit 180*a* fast to the stock rail 501.

Further, the joint portion 521*b* illustrated in FIG. 10 has the slide mechanisms 540*b* and 541*b*, so that, even when vibration caused when a vehicle passes displaces the stock rails 501, it is possible to absorb the displacement by the slide mechanisms 540*b* and 541*b* and supply compressed air. As a result, it is possible to prevent failure, damages, cracks or the like of the foreign material removing device 100*b* caused by the displacement.

In the present invention, the nozzle devices 101, 101*a* and 101*b* correspond to a piping unit, the stock rails 501 correspond to stock rails, the foreign material removing devices 100, 100*a* and 100*b* correspond to a foreign material removing device of a track turnout portion, the point rails 502 correspond to point rails, the bent portion 530 or the fixing member 525*a* of the joint portion 521 corresponds to a close-contact arrangement structure, the angle θ corresponds to an acute angle, the fixing members 522*a*, 523*a* and 525*a* correspond to a fixing portion, and the fixing member 524 corresponds to a member which has a tapered surface.

Although the preferred embodiments of the present invention have been described above, the present invention is not limited thereto. It is understood that various embodiments can be additionally made without deviating from the spirit and the scope of the present invention. Further, although the function and the effect provided by the configuration of the present invention have been described in the present embodiment, these function and effect are exemplary and by no means limit the present invention.

The invention claimed is:

1. A foreign material removing device of a track turnout portion which removes a foreign material dropped between a stock rail of the turnout portion and a point rail which can move to contact and move away from the stock rail, the foreign material removing device comprising:

a piping unit which includes a plurality of nozzle portions which spray compressed air to remove the foreign material, and a close-contact arrangement structure to which the piping unit is mounted and arranged so that the piping unit presses against a concave portion of a lateral surface of the stock rail opposed to the point rail by elastic deformation, wherein the close-contact arrangement structure is an elastically deformable structure, distinct from the nozzle portions and located in an area between the stock rail and the point rail, and includes a surface extending along the concave portion of the stock rail lateral surface with the surface forming an acute angle from a horizontal plane toward the concave portion of the stock rail lateral surface and away from the point rail.

2. The foreign material removing device of the track turnout portion according to claim 1, wherein the piping unit extends from below the stock rail to a lateral surface side which does not oppose the point rail, and is fastened by way of screwing in a vertical direction by a member which includes a tapered surface on a leg portion of the stock rail.

3. The foreign material removing device of the track turnout portion according to claim 1, wherein the close-contact arrangement structure is provided separately with a fixing portion which presses the piping unit against the concave portion of the lateral surface of the stock rail opposed to the point rail to fix, and a compressed air supply portion which supplies compressed air to the piping unit.

4. The foreign material removing device of the track turnout portion according to claim 3, wherein the compressed air supply portion includes an extendable mechanism.

5. The foreign material removing device of the track turnout portion according to claim 1 including a fixing member engaged with the elastically deformable structure provided along a lower surface of leg portions of the stock rail, and the horizontal plane is along a surface of the fixing member so that the fixing member surface and the elastically deformable structure surface forms the acute angle therebetween.

6. The foreign material removing device of the track turnout portion according to claim 1, including:

a first fixing member disposed below the stock rail, the stock rail including a first leg portion distal from the point rail and a second leg portion proximate the point rail, a second fixing member disposed on one end portion of the first fixing member so as to sandwich the first leg portion between the second fixing member and the first fixing member, the second fixing member having a tapered surface on its lower surface, a fixing portion for accommodating the second leg portion provided on the other end portion of the first fixing member, wherein the second fixing member is fastened to the one end portion of the first fixing member with a bolt in a vertical direction, and the first leg portion and the second leg portion of the stock rail are sandwiched between the second fixing member and the fixing portion such that the close-contact arrangement structure is elastically deformed with the piping unit pressing against the concave portion of the lateral surface of the stock rail.

7. The foreign material removing device of the track turnout portion according to claim 6, wherein the close-contact arrangement structure has a fixing member for supporting the piping unit, and the second fixing member is fastened to the one end portion of the first fixing member so that a lower portion of the fixing member is sandwiched between the fixing portion and the stock rail.

8. The foreign material removing device of the track turnout portion according to claim 6, wherein the close-contact arrangement structure has a fixing member which is elastically deformable provided at the other end portion of the first fixing member, the second fixing member is fastened to the one end portion of the first fixing member so that the fixing member is elastically deformed to cause the piping unit to press against a concave portion of the lateral surface of the stock rail.

9. The foreign material removing device of the track turnout portion according to claim 1, including:

a first fixing member disposed below a stock rail, the stock rail including a first leg portion distal from the point rail and a second leg portion proximate the point rail, a second fixing member disposed on one end portion of the first fixing member so as to sandwich the first leg portion between the second fixing member and the first fixing member, the second fixing member having a tapered surface on its lower surface, a fixing portion for accommodating the second leg portion provided on the other end portion of the first fixing member, wherein the second fixing member is fastened to one end portion of the first fixing member with a vertical direction bolt so that the close-contact arrangement structure is shifted against the lateral surface of the stock rail, the close-contact arrangement structure is elastically deformed, and the piping unit presses against the concave portion of the lateral surface of the stock rail.

10. The foreign material removing device of the track turnout portion according to claim 1, wherein the stock rail includes a first leg portion and a second leg portion, the first leg portion and the second leg portion being below the concave portion, a first fixing member is disposed along the first leg portion and the second leg portion of the stock rail below the stock rail, the first fixing member is movable in a horizontal direction along the first leg portion and the second leg portion of the stock rail, a second fixing member having a tapered surface formed at a lower surface of the second fixing member is disposed at one end of the first fixing member, and a fixing portion for accommodating the second leg portion is provided at the other end of the first fixing member, one of the leg portions of the stock rail is disposed between the second fixing member and the one end of the first fixing member, and the second fixing member is fastened to the first fixing member in a vertical direction by a bolt to sandwich the one of the leg portions of the stock rail between the one end of the first fixing member and the tapered surface of the second fixing member so that the fixing portion is moved toward the stock rail to sandwich a lower portion of a fixing member of the close-contact arrangement structure between the stock rail and the fixing portion of the first fixing member, the fixing member supporting the piping unit.

11. A foreign material removing device of a track turnout portion which comprises a stock rail of the track turnout portion, and a point rail that can move to contact and move away from the stock rail, and which removes a foreign material dropped between the stock rail and the point rail, the foreign material removing device comprising:

a piping unit which includes a plurality of nozzle portions which spray compressed air to remove the foreign material, and a close-contact arrangement structure including a fixing member that presses against a concave portion of a lateral surface of the stock rail opposed to the point rail, wherein the piping unit presses against the fixing member with the fixing member elastically deforming with respect to the concave portion of the lateral surface of the stock rail opposed to the point rail in a state where the piping unit presses against the concave portion of the lateral surface, and the close-contact arrangement structure comprises a structure whose angle from a horizontal plane of a surface of the piping unit opposed to the concave portion of the lateral surface is an acute angle toward the concave portion of the lateral surface.

12. The foreign material removing device of the track turnout portion according to claim 11, wherein the stock rail includes a first leg portion and a second leg portion, the first leg portion and the second leg portion being below the concave portion, a first fixing member is disposed along the first leg portion and the second leg portion of the stock rail below the stock rail, the first fixing member is movable in a horizontal direction along the first leg portion and the second leg portion of the stock rail, a second fixing member having a tapered surface formed at a lower surface of the second fixing member is disposed at one end of the first fixing member, and a fixing portion for accommodating the second leg portion is provided at the other end of the first fixing member, one of the leg portions of the stock rail is disposed between the second fixing member and the one end of the first fixing member, and the second fixing member is fastened to the first fixing member in a vertical direction by a bolt to sandwich the one of the leg portions of the stock rail between the one end of the first fixing member and the tapered surface of the second fixing member so that the fixing portion is moved toward the stock rail to sandwich a lower portion of the fixing member between the stock rail and the fixing portion of the first fixing member, the fixing member supporting the piping unit.

13. A foreign material removing device of a track turnout portion which comprises a stock rail of the track turnout portion, and a point rail that can move to contact and move away from the stock rail, and which removes a foreign material dropped between the stock rail and the point rail, the foreign material removing device comprising:

a piping unit disposed in an area between the stock rail and the point rail, wherein a fixing member that supports the piping unit is disposed at a belly portion of a lateral surface of the stock rail, and the fixing member is formed of an elastic member, the stock rail includes a first leg portion and a second leg portion, the first leg portion and the second leg portion being provided below the belly portion, a first fixing member is disposed along the first leg portion and the second leg portion of the stock rail below the stock rail, the first fixing member is movable in a horizontal direction along the first leg portion and the second leg portion of the stock rail, a second fixing member having a tapered surface formed at a lower surface of the second fixing member is disposed at one end of the first fixing member, and a fixing portion for accommodating the second leg portion is provided at the other end of the first fixing member, and one of the leg portions of the stock rail is disposed between the second fixing member and the one end of the first fixing member, the second fixing member is fastened to the first fixing member to sandwich the one of the leg portions of the stock rail between the one end of the first fixing member and the tapered surface of the second fixing member, and the fixing portion is moved toward the stock rail to bring the piping unit into close contact with a side of the stock rail in a state where the piping unit presses against the belly portion of the stock rail.

14. The foreign material removing device according to claim 13, wherein the second fixing member is fastened to the first fixing member in a vertical direction by a bolt.

* * * * *